US006068152A

United States Patent [19]

Meiners et al.

[11] Patent Number: 6,068,152

[45] Date of Patent: May 30, 2000

[54] SHIPPING CONTAINER FOR HIGHLY VISCOUS FLUIDS AND/OR PASTES

[75] Inventors: Reiner Meiners, Schermbeck; Matthias Tonjes, Radebeul; Hans-Gunter Sparenberg, Marl, all of Germany

[73] Assignee: Wacker-Chemie GmbH, Munich, Germany

[21] Appl. No.: 09/201,758

[22] Filed: Dec. 1, 1998

[30] Foreign Application Priority Data

Dec. 1, 1997 [DE] Germany ..... 197 53 221

[51] Int. Cl.[7] ..... B65D 35/28

[52] U.S. Cl. ..... 220/1.6; 220/723

[58] Field of Search ..... 220/720, 721, 220/723, 586, 495.01, 495.04, 495.05, 529, 530, 62.22, 86.1, 62.21, 1.6

[56] References Cited

U.S. PATENT DOCUMENTS

| | | | |
|---|---|---|---|
| 3,347,406 | 10/1967 | Katzenmeyer | 220/530 |
| 3,883,046 | 5/1975 | Thompson et al. | 222/386.5 |
| 4,044,912 | 8/1977 | Nichols | 220/449 |
| 4,364,416 | 12/1982 | Jacobellis et al. | 138/30 |

FOREIGN PATENT DOCUMENTS

| | | |
|---|---|---|
| 0 648 708 | 4/1995 | European Pat. Off. . |
| 1 500 609 | 3/1972 | Germany . |
| 79 14 394 | 9/1979 | Germany . |
| 755624 | 8/1956 | United Kingdom . |

*Primary Examiner*—Stephen Castellano
*Attorney, Agent, or Firm*—Oblon, Spivak, McClelland, Maier & Neustadt, P.C.

[57] ABSTRACT

A shipping container for highly viscous fluids and/or pastes is provided internally with a flexible liquid-tight and gas-tight rubber bladder in which there is disposed a support frame. The rubber bladder can flexibly conform to a first position pressing against the container shell inside wall and to a second position pressing against the support frame.

4 Claims, 2 Drawing Sheets

FIG. 1A
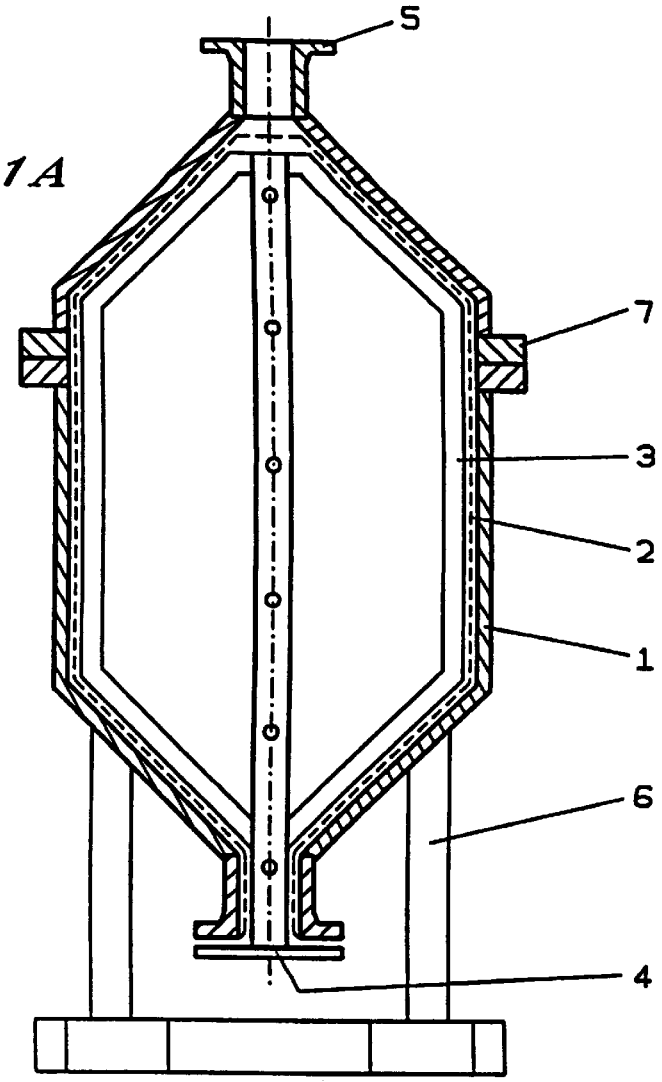
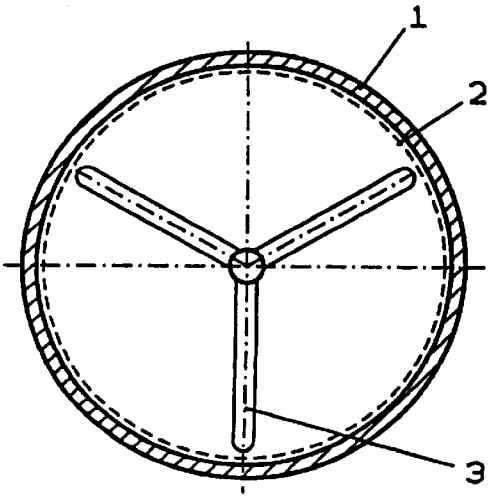
FIG. 1B
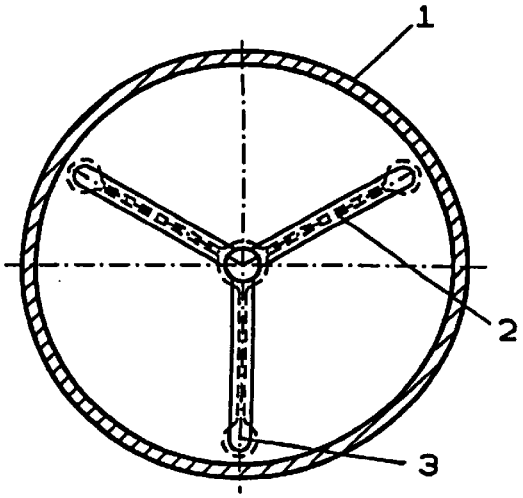
FIG. 1C

FIG. 2A
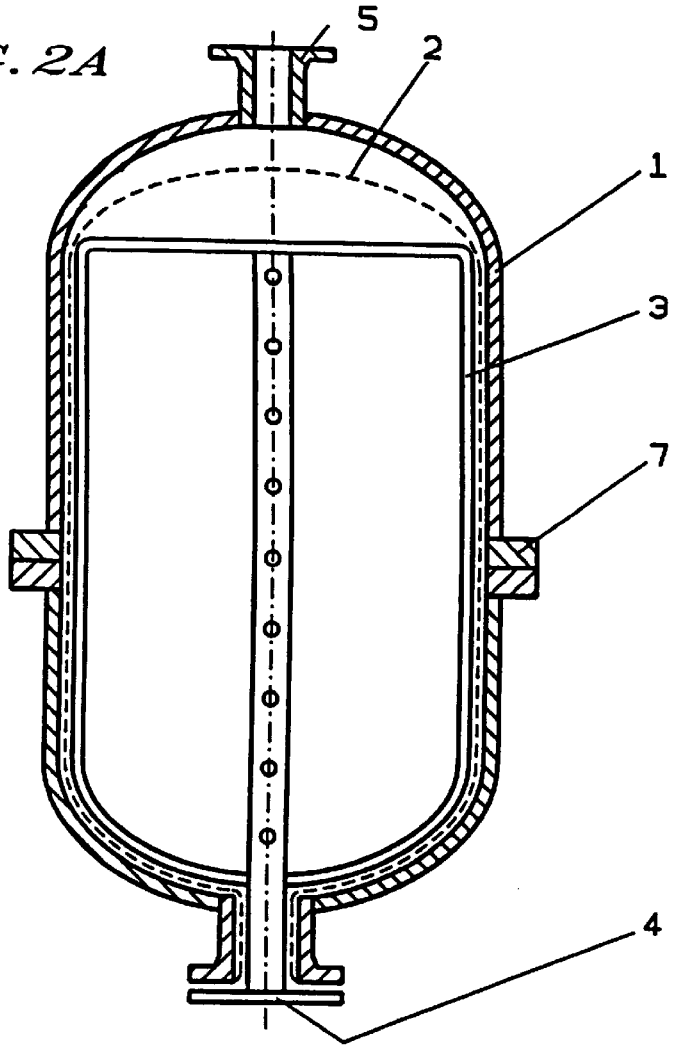
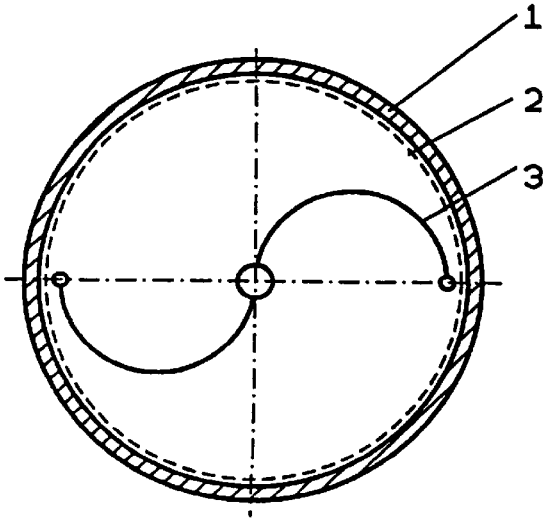
FIG. 2B
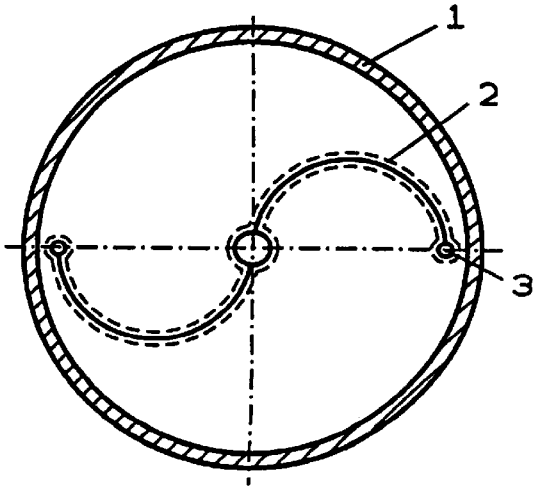
FIG. 2C

SHIPPING CONTAINER FOR HIGHLY VISCOUS FLUIDS AND/OR PASTES

BACKGROUND OF THE INVENTION

1. Field of the Invention

The invention relates to a shipping container for highly viscous fluids and/or pastes which is provided internally with a flexible liquid-tight and gas-tight rubber bladder in which there is disposed a support frame.

2. Description of the Related Art

It is known that highly viscous fluids and pastes can be stored in containers. For example, EP 0648708 describes a container comprising lower and upper halves joined together at a flanged joint. A hat-shaped diaphragm clamped therein separates the lower product space from the upper container space and covers either the upper or lower container half during filling or emptying. The container can be provided on the side opposite the outlet opening with a connection for a pressurized medium such as compressed air, and thus can be emptied by pressurizing the membrane with compressed air on the side remote from the product. Since the product is in contact with the lower section of the container, its material must comprise either stainless steel or carbon steel with product-resistant lining. Furthermore, the container must be opened and in some cases completely emptied or cleaned in connection with product changes and diaphragm inspections. The resulting ingress of atmospheric moisture into the container is undesirable, especially when filling with silicone paste.

DE 4242833 discloses a container provided between an upper and lower rigid head with liquid-tight, flexible and foldable side walls resembling bellows. A disadvantage of this container is the inadequate emptying of residues because product is retained in the folds of the side walls.

SUMMARY OF THE INVENTION

It is an object of the invention to provide a shipping container for highly viscous fluids and/or pastes, especially for viscous polysiloxanes, in which the highly viscous fluids and/or pastes never come into contact with the container wall and which ensures both good emptying of residues and unproblematic product changes in addition to a long service life.

According to the invention, the above and other objects are achieved by a shipping container for highly viscous fluids and/or pastes, especially for viscous polysiloxanes, which is provided internally with an inspectable, flexible, liquid-tight and gas-tight rubber bladder fixed in an outlet flange, in which bladder is disposed a support frame adapted to the size of both rubber bladder and container dimension, and the rubber bladder in a first position corresponding to the filled condition, presses against the container inside wall and in a second position corresponding to the emptied condition, presses against the support frame.

The shape of the rubber bladder corresponds preferably to the shape of the support frame and/or the shape of the container, thus ensuring substantially complete emptying. Star-shaped or s-shaped support frames have proved very suitable. Of course, frames of other geometry are also possible as long as the rubber bladder can cling closely to them in the emptied condition. As a result, stresses in the rubber material as well as uncontrolled or severe collapse of the bladder are prevented, and so the life thereof is extended. The bladder comprises elastic, rubbery material which should be matched to the requirements of the respective product.

Usually the container comprises two sections joined together by a flange and provided with a closable outlet flange and a connecting piece for introduction of a pressurized medium. The choice of material for the container is not complicated. For example, simple carbon steel is adequate since the container wall does not come into contact with the product and thus also does not have to be specially lined. The size of the shipping container depends on the size of the rubber bladder. Usually the bladder volume is about 2,000 liters. The container is usually mounted on a stand structure for which fittings of any desired form are conceivable. For example, transport by fork-lift machine should be possible.

The bladder is filled and emptied via the outlet flange. The emptying process is accelerated by admission of a pressurized medium such as compressed air. In the process, the bladder deforms until it presses against the support frame. After emptying, the outlet flange can be closed airtightly.

By virtue of the specially designed shape of the support frame in the shipping container and of the rubber bladder between support frame and container, the bladder collapses in controlled manner and a high percentage of the residues can be emptied. The support frame can be made of materials that are inert to the product contained in the bladder, such as rubberized or coated carbon steel or stainless steel. Of course plastics such as PTFE can also be used and the frame can be assembled from pipes, which may or may not be perforated, from gratings or from steel plates. In each case the support frame should be dimensioned such that it permits optimum filling and emptying of the rubber bladder.

Since the rubber bladder is fixed at the outlet flange, normally by clamping, the container can be opened without problems via the flange joining the two container sections, usually when the bladder is empty. Consequently, both the bladder and inside wall of the shipping container can be inspected without allowing atmospheric moisture into the bladder. As another advantage, the bladder can also be completely replaced without complications, for example to permit change of product. For this purpose, it is removed completely and replaced by another bladder, including support frame if necessary, without having to clean the container or the used bladder.

The shipping container is suitable for storing and transporting highly viscous fluids and/or pastes. In particular, viscous polysiloxanes such as silicone rubber compounds that undergo cross-linking in the presence of atmospheric moisture at room temperature, highly viscous silicone polymers or viscous silicone oils can be stored therein. Many of these products are reactive to atmospheric moisture. It is precisely for this product group that the shipping container according to the invention is eminently suitable, since the product is always enclosed completely by the flexible, liquid-tight and gas-tight rubber bladder and does not come into contact with the container wall or air.

BRIEF DESCRIPTION OF THE DRAWINGS

Examples of the invention will be described hereinafter with reference to the following figures in which:

FIG. 1 is a vertical cross section of a shipping container according to a first embodiment of the invention;

FIG. (1*a*) is a horizontal cross section of the shipping container of FIG. 1 in the first position (bladder filled);

FIG. (1*b*) is a horizontal cross section of the shipping container of FIG. 1 in the second position (bladder emptied);

FIG. 2 is a vertical cross section of a shipping container according to a first embodiment of the invention;

FIG. (2*a*) is a horizontal cross section of the shipping container of FIG. 1 in the first position (bladder filled); and FIG. (2*b*) is a horizontal cross section of the shipping container of FIG. 1 in the second position (bladder emptied).

DETAILED DESCRIPTION OF THE PREFERRED EMBODIMENTS

FIG. 1 is a vertical cross section of a first embodiment of a shipping container according to the invention. The shipping container has a rigid container shell (1) with conically shaped lower and upper ends. The container shell (1) comprises two sections joined together above the center by means of a flange (7). The lower one of the sections has a product outlet (4), and the upper of the sections has a flanged inlet (5) for introducing a pressurized medium.

The container shell stands on a frame (6). Inside the container shell there is disposed a rubber bladder (2) which is fixed at the outlet flange (4) and is held by a star-shaped support frame (3). The horizontal cross section of the shipping container in the first position (bladder filled) is illustrated in FIG. (1*a*) and in the second position (bladder emptied) is illustrated in FIG. (1*b*). The rubber bladder clings either completely to the container wall (FIG. 1A) or completely to the support frame (FIG. 1B).

FIG. 2 illustrates the cross section through a second embodiment of a container, this time having an S-shaped support frame. Here again the cross section of the container is illustrated with filled bladder in FIG. (2*a*) and with emptied bladder in FIG. (2*b*).

What is claimed is:

1. A shipping container for highly viscous fluids and/or pastes, comprising:

a container shell having a product outlet;

a flexible, liquid-tight and gas-tight rubber bladder fixed at said product outlet;

an S-shaped support frame in said bladder and conforming to the size of both rubber bladder and the container shell, wherein the rubber bladder can flexibly conform to a first position pressing against the container shell inside wall and to a second position pressing against the support frame.

2. A shipping container according to claim 1, wherein the container shell comprises two sections joined together, one of the sections having the product outlet, and the other of said sections having an inlet for introducing a pressurized medium.

3. A shipping container according to claim 1, wherein the shape of the rubber bladder can correspond to the shape of one of the support frame and the shape of the container shell.

4. A shipping container according to claim 1, wherein the support frame is star-shaped.

* * * * *